US006629477B2

(12) United States Patent
Ling et al.

(10) Patent No.: US 6,629,477 B2
(45) Date of Patent: Oct. 7, 2003

(54) REVERSIBLE RATCHET WRENCH WITH HIGH TORSION

(75) Inventors: David Ling, Taichung (TW); Hsien-Chung Tuan-Mu, Taichung (TW)

(73) Assignee: Hand Tool Design Corporation, Christiana, DE (US)

( * ) Notice: Subject to any disclaimer, the term of this patent is extended or adjusted under 35 U.S.C. 154(b) by 0 days.

(21) Appl. No.: 09/885,034

(22) Filed: Jun. 21, 2001

(65) Prior Publication Data

US 2002/0088312 A1 Jul. 11, 2002

(30) Foreign Application Priority Data

Jan. 11, 2001 (TW) ..... 89208905 U

(51) Int. Cl.[7] ..... B25B 13/46
(52) U.S. Cl. ..... 81/63.2; 81/63
(58) Field of Search ..... 81/63.2, 63.1, 81/63, 62, 61, 60

(56) References Cited

U.S. PATENT DOCUMENTS 4,336,728 A * 6/1982 Deibert ..... 81/62
6,044,731 A 4/2000 Hsieh ..... 81/63.2
6,161,454 A * 12/2000 Chaconas ..... 81/63
6,230,591 B1 * 5/2001 Ling et al. ..... 81/63
6,282,991 B1 * 9/2001 Hu ..... 81/63.2
6,282,992 B1 * 9/2001 Hu ..... 81/63.2
6,301,998 B1 * 10/2001 Hu ..... 81/60
6,308,594 B1 * 10/2001 Cheng ..... 81/62

OTHER PUBLICATIONS

Hu, Bobby, "Positioning Device for a Switch Member of a Reversible Ratchet–Type Wrench", Nov. 1, 2001, Pub. No. 2001/0035074 A1, entire document.*

* cited by examiner

*Primary Examiner*—Joseph J. Hail, III
*Assistant Examiner*—David B. Thomas
(74) *Attorney, Agent, or Firm*—Nelson Mullins Riley & Scarborough, LLP

(57) ABSTRACT

A reversible ratchet wrench includes a handle having a driving head defining a driving chamber, a receiving chamber defined in the handle, a retaining recess defined in the driving chamber and connecting to the receiving chamber, and a driving member secured in the driving chamber and provided with a plurality of tooth-shaped first retaining portions. A direction control device includes a direction control member rotatably mounted in the receiving chamber, a retaining member pivotally mounted in the retaining recess and having a first side provided with a plurality of tooth-shaped second retaining portions meshing with the tooth-shaped first retaining portions, a pressing member rotated by the direction control member and slidably rested on a second side of the retaining member for pivoting the retaining member, and an elastic member urging the pressing member on the second side of the retaining member.

2 Claims, 11 Drawing Sheets

REVERSIBLE RATCHET WRENCH WITH HIGH TORSION

BACKGROUND OF THE INVENTION

1. Field of the Invention

The present invention relates to a reversible ratchet wrench, and more particularly to a reversible ratchet wrench with a high torsion.

2. Description of the Related Art

A conventional reversible ratchet wrench 80 in accordance with the prior art shown in FIG. 12 comprises a handle 81 having an enlarged driving head 82 defining a driving chamber 83 and a retaining recess 84 connecting to the driving chamber 83, a driving member 86 secured in the driving chamber 83, a direction change device "B" including a retaining member 21 pivotally mounted on a pivot axle 20 and including a tooth-shaped retaining portion 210 meshing with the driving member 86, a pressing device "C" including a pressing member 23 urged on the positioning protrusion 211 of the retaining member 21, and a spring 24 biased between the pressing member 23 and the handle 81.

However, the conventional reversible ratchet wrench in accordance with the prior art has the following disadvantages.

1. The retaining member 21 is engaged with the driving member 86 so that the force exerted on the retaining member 21 is directly transmitted to the pivot axle 20. Therefore, when the driving member 86 is used to drive and operate a workpiece, the force is entirely concentrated on the pivot axle 20 so that the pivot axle 20 is easily worn out, thereby shortening the lifetime of the ratchet wrench.

2. The locking force exerted by the retaining member 21 on the driving member 86 is supplied by the pivot axle which can only afford a limited locking force so that when the driving member 86 is used to drive a large workpiece, the retaining member 21 cannot efficiently lock and retain the driving member 86 so that the driving member 86 easily slips on the retaining member 21, thereby causing the ratchet wrench inoperative.

3. When the user wishes to change the driving direction of the ratchet wrench, the retaining member 21 is rotated about the pivot axle 20 to move the positioning protrusion 211 which then presses the pressing member 23 inward so that the positioning protrusion 211 can be moved to and located on the other side of the pressing member 23. In such a manner, the positioning protrusion 211 is frequently engaged with the pressing member 23, thereby greatly increasing the friction therebetween so that the positioning protrusion 211 is easily worn out during long-term utilization.

SUMMARY OF THE INVENTION

In accordance with an embodiment of the present invention, there is provided a reversible ratchet wrench comprising: a handle having an enlarged driving head defining a driving chamber therein, a receiving chamber defined in the handle and located adjacent to the driving chamber, a retaining recess defined in a side wall of the driving chamber and connecting to the receiving chamber; a driving member secured in the driving chamber and having an outer wall provided with a plurality of tooth-shaped first retaining portions; and a direction control device mounted on the handle.

The direction control device includes: a direction control member rotatably mounted in the receiving chamber; a retaining member pivotally mounted in the retaining recess and having a first side provided with a plurality of tooth-shaped second retaining portions meshing with the plurality of tooth-shaped first retaining portions; a pressing member mounted between the receiving chamber and the retaining recess, the pressing member being secured on the direction control member to rotate therewith and slidably rested on a second side of the retaining member for pivoting the retaining member; and an elastic member mounted between the direction control member and the pressing member for urging the pressing member on the second side of the retaining member.

In accordance with another embodiment of the present invention, each of the second retaining portions of the retaining member has two sides each formed with a convex arcuate edge and a mediate section located between the two sides and formed with a locking edge.

Further benefits and advantages of the present invention will become apparent after a careful reading of the detailed description with appropriate reference to the accompanying drawings.

DETAILED DESCRIPTION OF THE INVENTION

Figure 1:
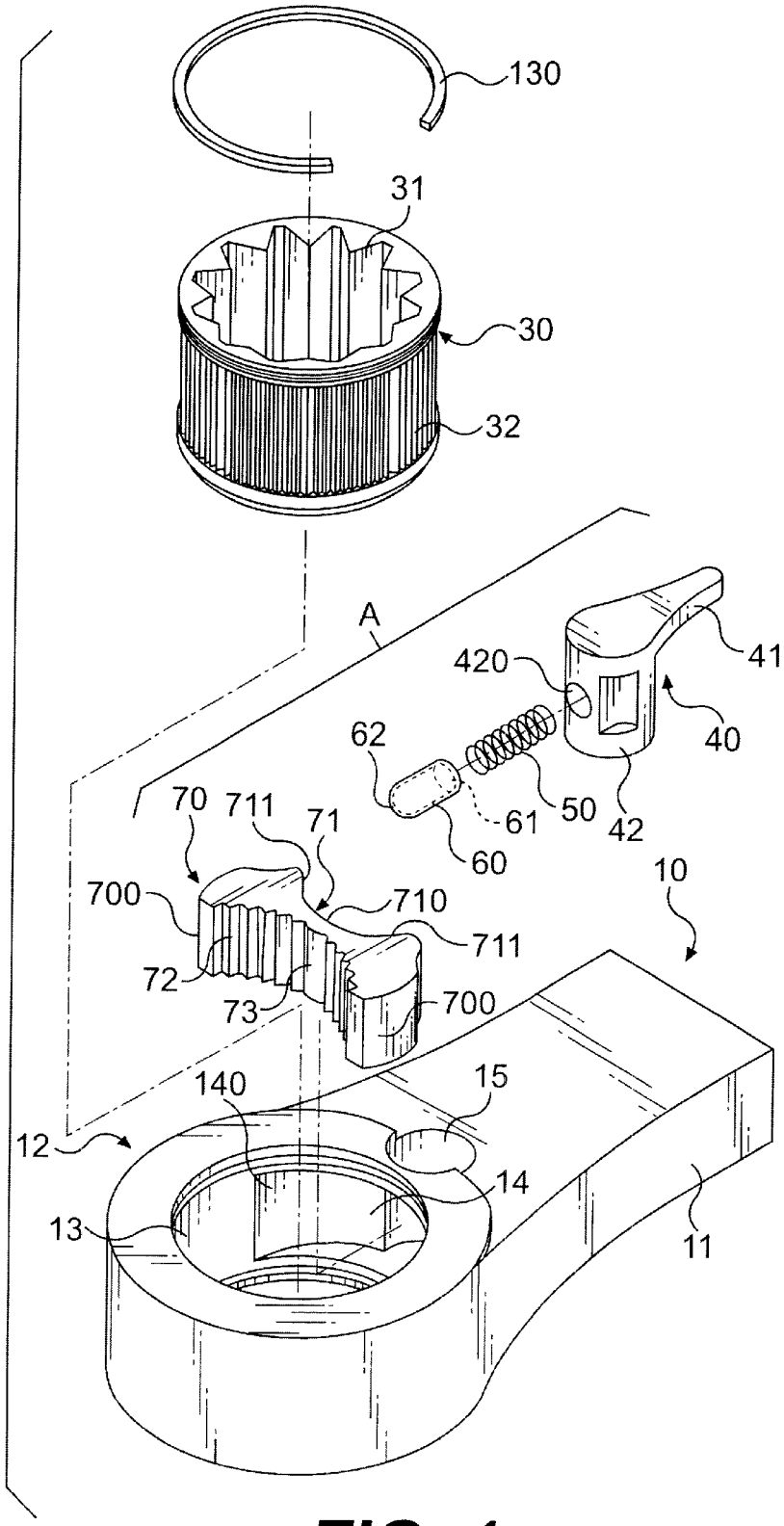
FIG. 1 is an exploded perspective view of a reversible ratchet wrench in accordance with the present invention.

Referring to the drawings and initially to FIGS. 1–4, a reversible ratchet wrench 10 in accordance with the present invention comprises a handle 11 having an enlarged driving head 12 defining a driving chamber 13 therein, an opened receiving chamber 15 defined in the handle 11 and located adjacent to the driving chamber 13, a retaining recess 14 defined in a side wall of the driving chamber 13 and connecting to the opened receiving chamber 15, a driving member 30 secured in the driving chamber 13 and having an inner wall defining a plurality of driving grooves 31 and an outer wall provided with a plurality of tooth-shaped first retaining portions 32, and a C-shaped snap ring 130 mounted in the driving chamber 13 and urged on the top of the driving member 30 for securing the driving member 30 in the driving chamber 13.

The retaining recess 14 is inclined with the receiving chamber 15, and the included angle defined between the retaining recess 14 and the receiving chamber 15 is ranged between 60° to 80°.

A direction control device "A" is mounted on the handle 11 and includes a direction control member 40 rotatably mounted in the receiving chamber 15, a retaining member 70 pivotally mounted in the retaining recess 14 and having a first side provided with a plurality of tooth-shaped second retaining portions 72 meshing with the plurality of tooth-shaped first retaining portions 32, a pressing member 60 mounted between the receiving chamber 15 and the retaining recess 14, and an elastic member 50 mounted between the direction control member 40 and the pressing member 60 for urging the pressing member 60 on a second side of the retaining member 70.

The direction control member 40 includes a body 42 rotatably mounted in the receiving chamber 15, and a driving knob 41 secured on the body 42 and extending outward from the receiving chamber 15 for rotating the body 42. The body 42 of the direction control member 40 defines a first receiving recess 420 for receiving the pressing member 60 therein, and the pressing member 60 defines a second receiving recess 61 for receiving the elastic member 50 which is biased between the wall of the first receiving recess 420 and the wall of the second receiving recess 61.

The pressing member 60 is movably secured on the direction control member 40 to rotate therewith and is slidably rested on the second side of the retaining member 70 for pivoting the retaining member 70.

The pressing member 60 includes an arcuate pressing head 62, and the second side of the retaining member 70 defines an arcuate pressing recess 71 for receiving the pressing head 62 of the pressing member 60. The pressing recess 71 of the retaining member 70 has a mediate portion provided with a flat slide face 710 for allowing movement of the pressing head 62 of the pressing member 60, and two ends each provided with a limit edge 711 for limiting movement of the pressing head 62 of the pressing member 60.

The first side of the retaining member 70 has a mediate portion provided with an arcuate support portion 73 located between the second retaining portions 72. The pressing recess 71 of the retaining member 70 has a width greater than that of the support portion 73 of the retaining member 70 so that when the pressing head 62 of the pressing member 60 is moved in the pressing recess 71 of the retaining member 70, the retaining member 70 can be actually pivoted about the support portion 73.

Figure 6:
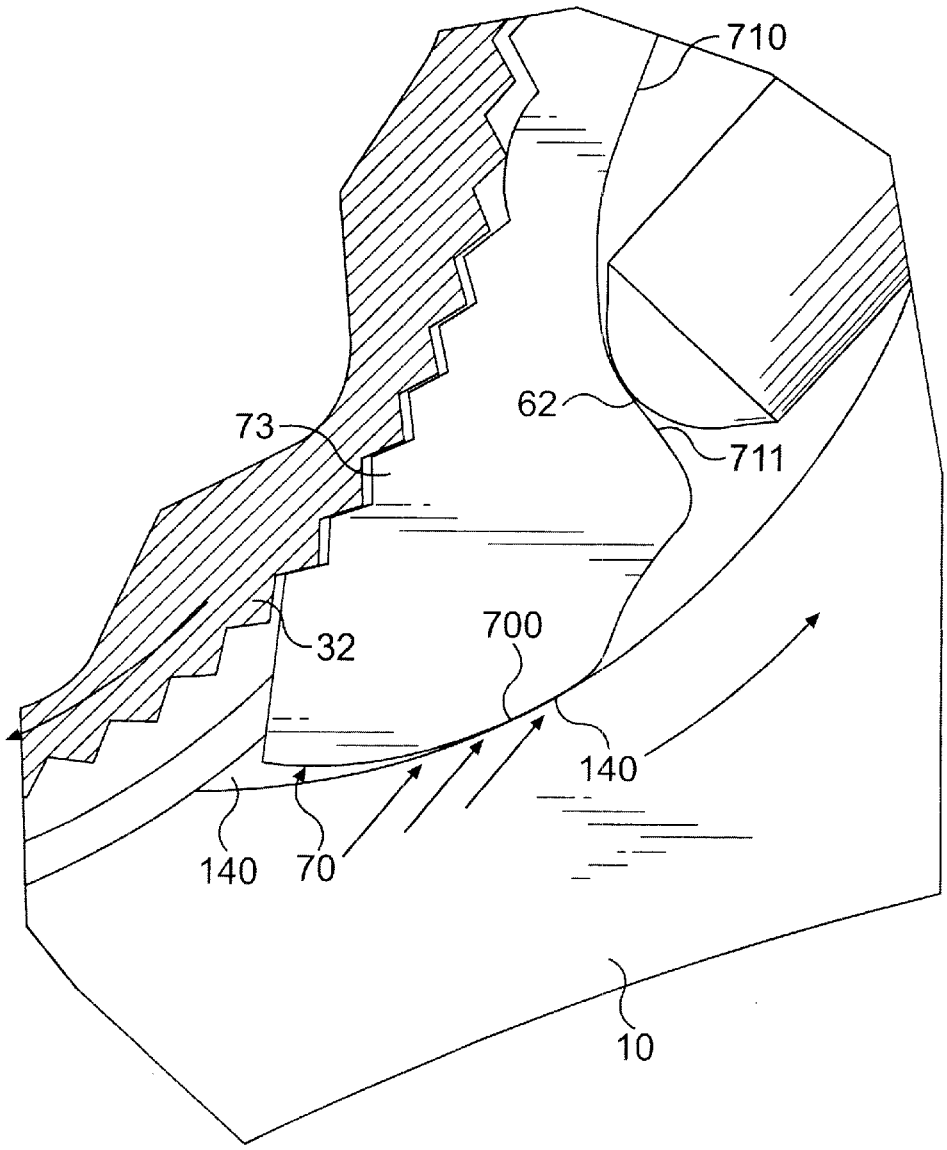
FIG. 6 is a partially cut-away enlarged view of the reversible ratchet wrench as shown in FIG. 5.

The retaining member 70 has two ends each formed with an arcuate surface 700 detachably urged on an arcuate retaining wall 140 of the retaining recess 14 as shown in FIG. 6.

Figure 2:
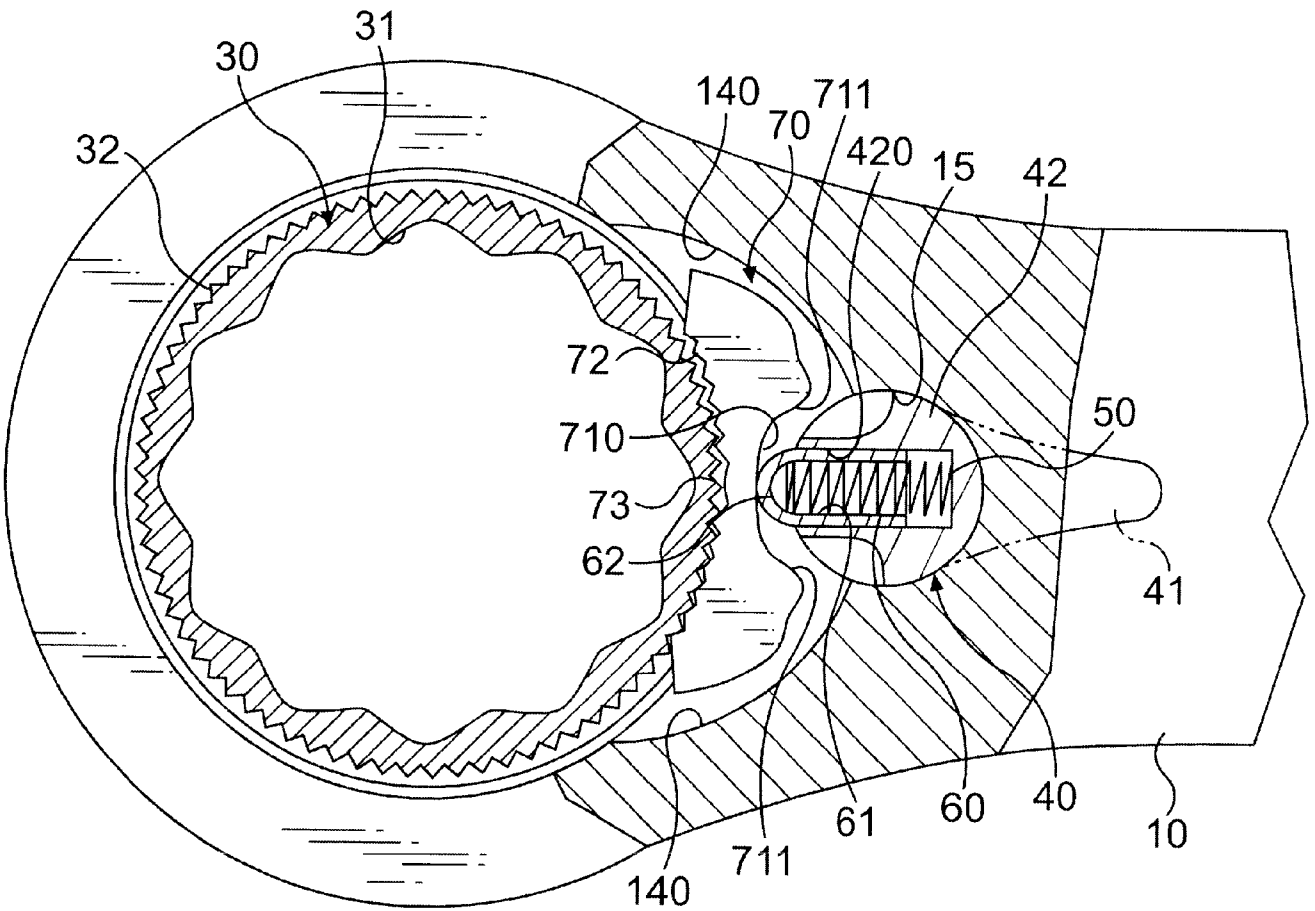
FIG. 2 is a top plan cross-sectional assembly view of the reversible ratchet wrench as shown in FIG. 1.
Figure 3:
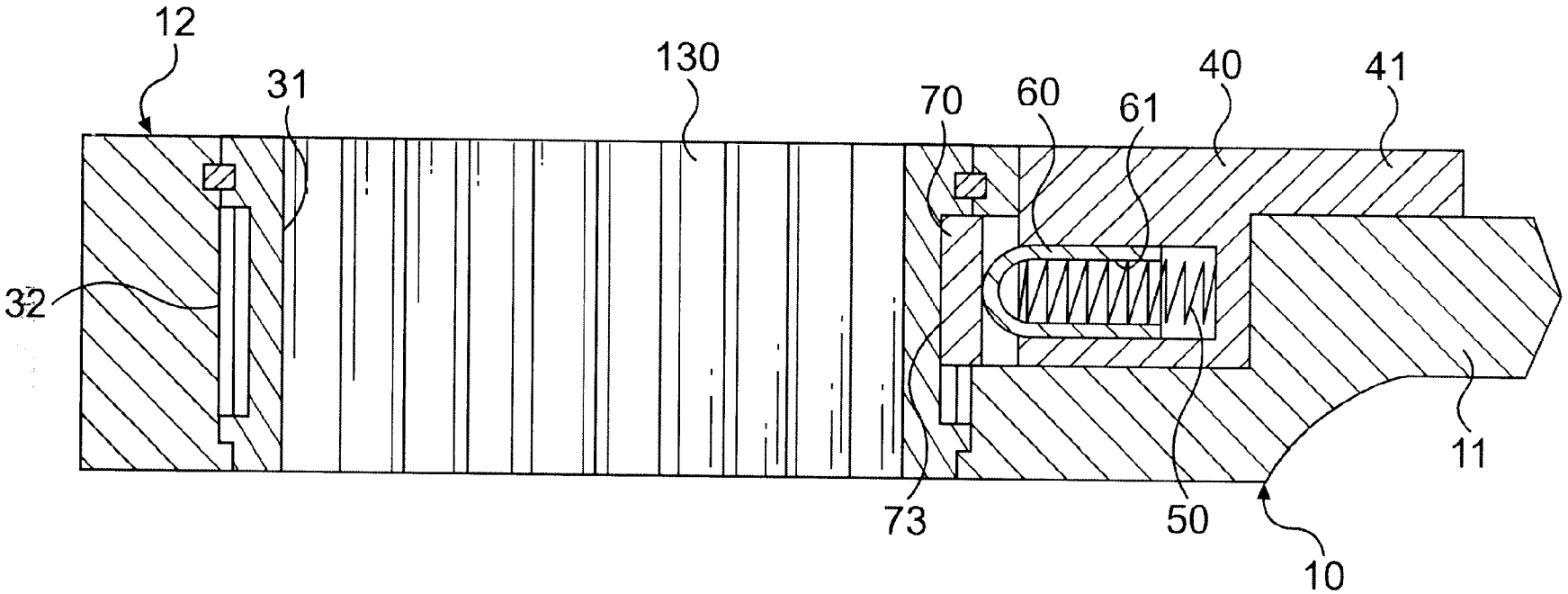
FIG. 3 is a front plan cross-sectional assembly view of the reversible ratchet wrench as shown in FIG. 1.
Figure 4:
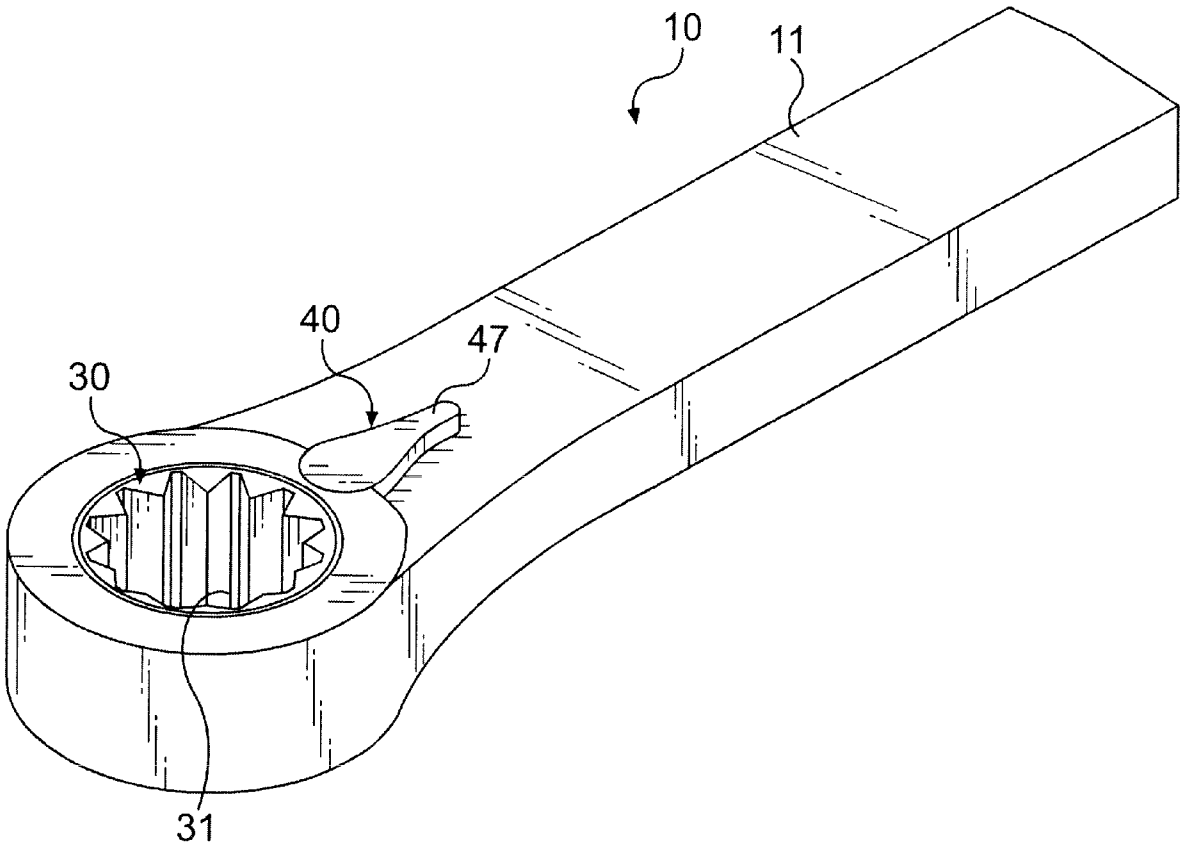
FIG. 4 is a perspective assembly view of the reversible ratchet wrench as shown in FIG. 1.

In operation, referring to FIGS. 1–6, when the driving knob 41 of the direction control member 40 is disposed at the position as shown in FIG. 2, the pressing head 62 of the pressing member 60 is rested on the slide face 710 of pressing recess 71 of the retaining member 70 whereby the support portion 73 of the retaining member 70 is pushed to abut the outer wall of the driving member 30 so that the tooth-shaped second retaining portions 72 at the two ends of the retaining member 70 are slightly detached from the tooth-shaped first retaining portions 32 of the driving member 30.

Figure 5:
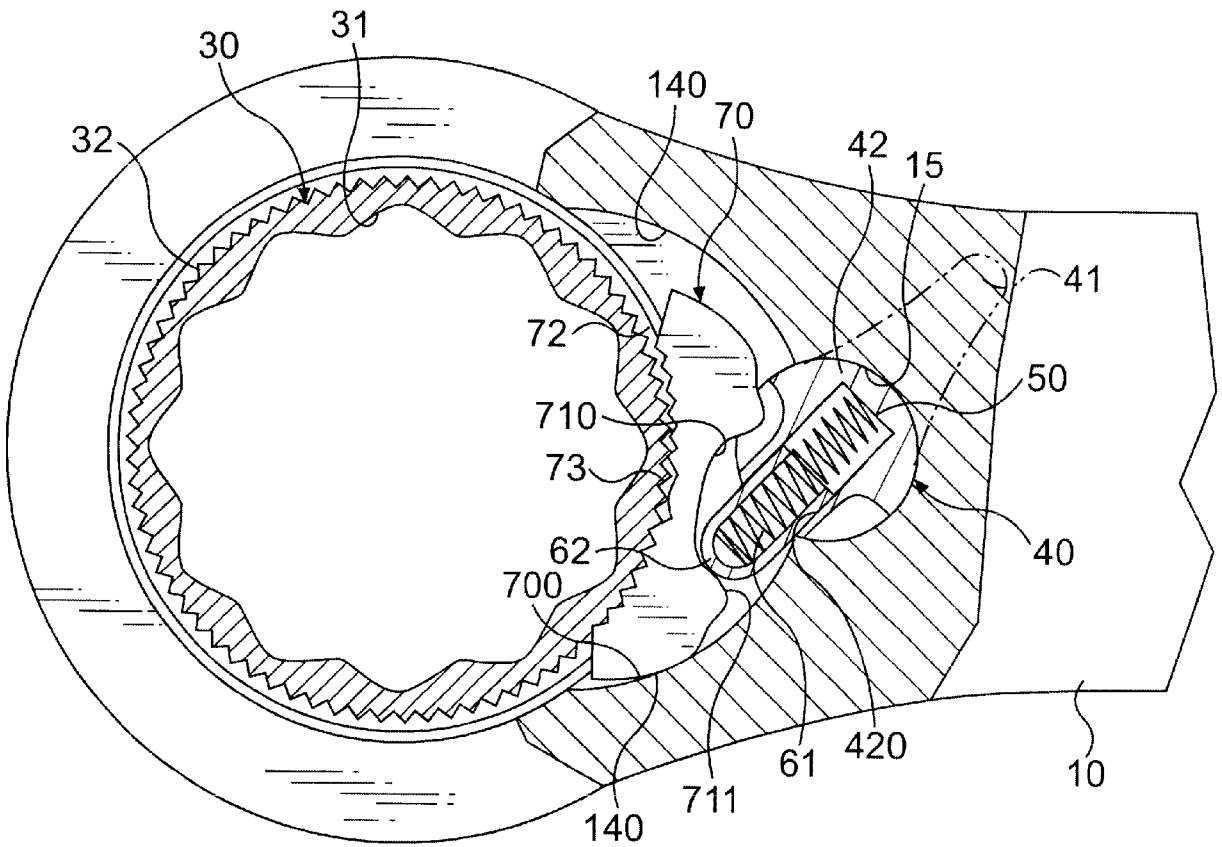
FIG. 5 is an operational view of the reversible ratchet wrench as shown in FIG. 2 in use.

When the driving knob 41 of the direction control member 40 is moved from the position as shown in FIG. 2 to the position as shown in FIG. 5, the pressing head 62 of the pressing member 60 is rotated with the body 42 of the direction control member 40 to move in the pressing recess 71 from the slide face 710 to the limit edge 711 at one end of the pressing recess 71 to press the limit edge 711 of the retaining member 70 toward the driving member 30, thereby pivoting the retaining member 70 about the support portion 73 so that the tooth-shaped second retaining portions 72 at one end of the retaining member 70 are engaged with the tooth-shaped first retaining portions 32 of the driving member 30.

In such a manner, when the handle 11 of the ratchet wrench 10 is rotated in the clockwise direction of FIG. 5, the arcuate surface 700 of the retaining member 70 is received and pressed between the retaining wall 140 of the retaining recess 14 and the outer wall of the driving member 30 so that the arcuate surface 700 of the retaining member 70, the retaining wall 140 of the retaining recess 14, and the outer wall of the driving member 30 co-operate with each other to form a tight fit engagement as shown in FIGS. 5 and 6, thereby constructing a rigid driving ratchet wrench structure which conforms to the requirement of a high torsion so that the driving member 30 can be synchronously rotated with the handle 11 to provide a high torsion for rotating a workpiece (not shown) in the clockwise direction.

Figure 7:
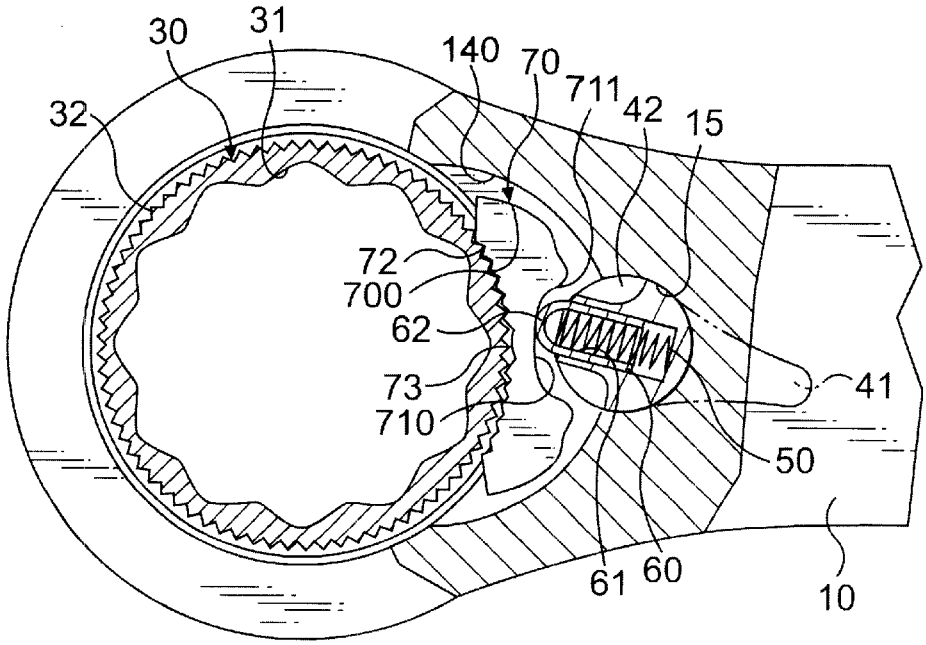
FIG. 7 is an operational view of the reversible ratchet wrench as shown in FIG. 2.
Figure 8:
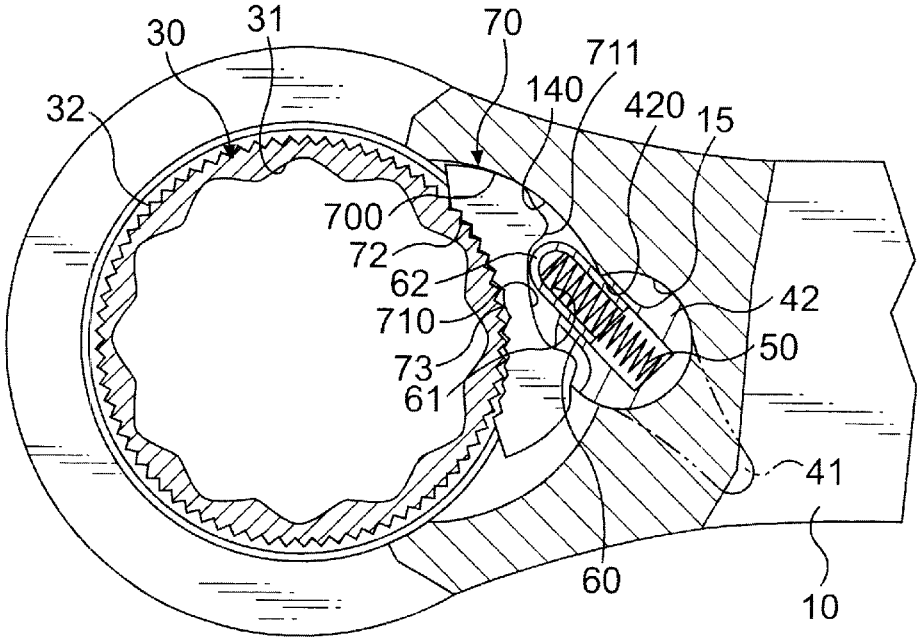
FIG. 8 is an operational view of the reversible ratchet wrench as shown in FIG. 7 in use.

Alternatively, referring to FIGS. 7 and 8, when the user wishes to change the driving direction of the ratchet wrench, the driving knob 41 of the direction control member 40 is moved from the position as shown in FIG. 7 to the position as shown in FIG. 8, so that the pressing head 62 of the pressing member 60 is rotated with the body 42 of the direction control member 40 to move in the pressing recess 71 from the slide face 710 to the limit edge 711 at the other end of the pressing recess 71 to press the limit edge 711 of the retaining member 70 toward the driving member 30, thereby pivoting the retaining member 70 about the support portion 73 so that the tooth-shaped second retaining portions 72 at the other end of the retaining member 70 are engaged with the tooth-shaped first retaining portions 32 of the driving member 30.

In such a manner, when the handle 11 of the ratchet wrench 10 is rotated in the counterclockwise direction of FIG. 8, the arcuate surface 700 of the retaining member 70 is received and pressed between the retaining wall 140 of the retaining recess 14 and the outer wall of the driving member 30 so that the arcuate surface 700 of the retaining member 70, the retaining wall 140 of the retaining recess 14, and the outer wall of the driving member 30 co-operate with each other to form a tight fit engagement as shown in FIG. 8, thereby constructing a rigid driving ratchet wrench structure which conforms to the requirement of a high torsion so that the driving member 30 can be synchronously rotated with the handle 11 to provide a high torsion for rotating the workpiece (not shown) in the counterclockwise direction.

Accordingly, the reversible ratchet wrench 10 in accordance with the present invention has the following advantages.

1. The retaining member 70 is rigidly engaged with the driving member 30 by means of multiple tooth-shaped second retaining portions 72 meshing with the multiple tooth-shaped first retaining portions 32, while the retaining member 70 is engaged with the retaining wall 140 of the retaining recess 14 by a large contact area so that the force is evenly distributed so as to increase the tolerance of the relative structural strength, thereby reducing the damage of the ratchet wrench structure, and thereby increasing the lifetime of the ratchet wrench structure.

2. The retaining member 70 is engaged with the retaining wall 140 of the retaining recess 14 by a large contact area, thereby increasing the tolerance to the torsion of the ratchet wrench structure so as to form a ratchet wrench structure with a high torsion.

3. The pressing head 62 of the pressing member 60 is smoothly moved on the slide face 710 of the pressing recess 71 of the retaining member 70 so that the friction between the pressing head 62 and the slide face 710 is reduced to the minimum, thereby preventing the ratchet wrench structure from being worn out during long-term utilization, and thereby assuring the integrity of the ratchet wrench structure.

Figure 9:
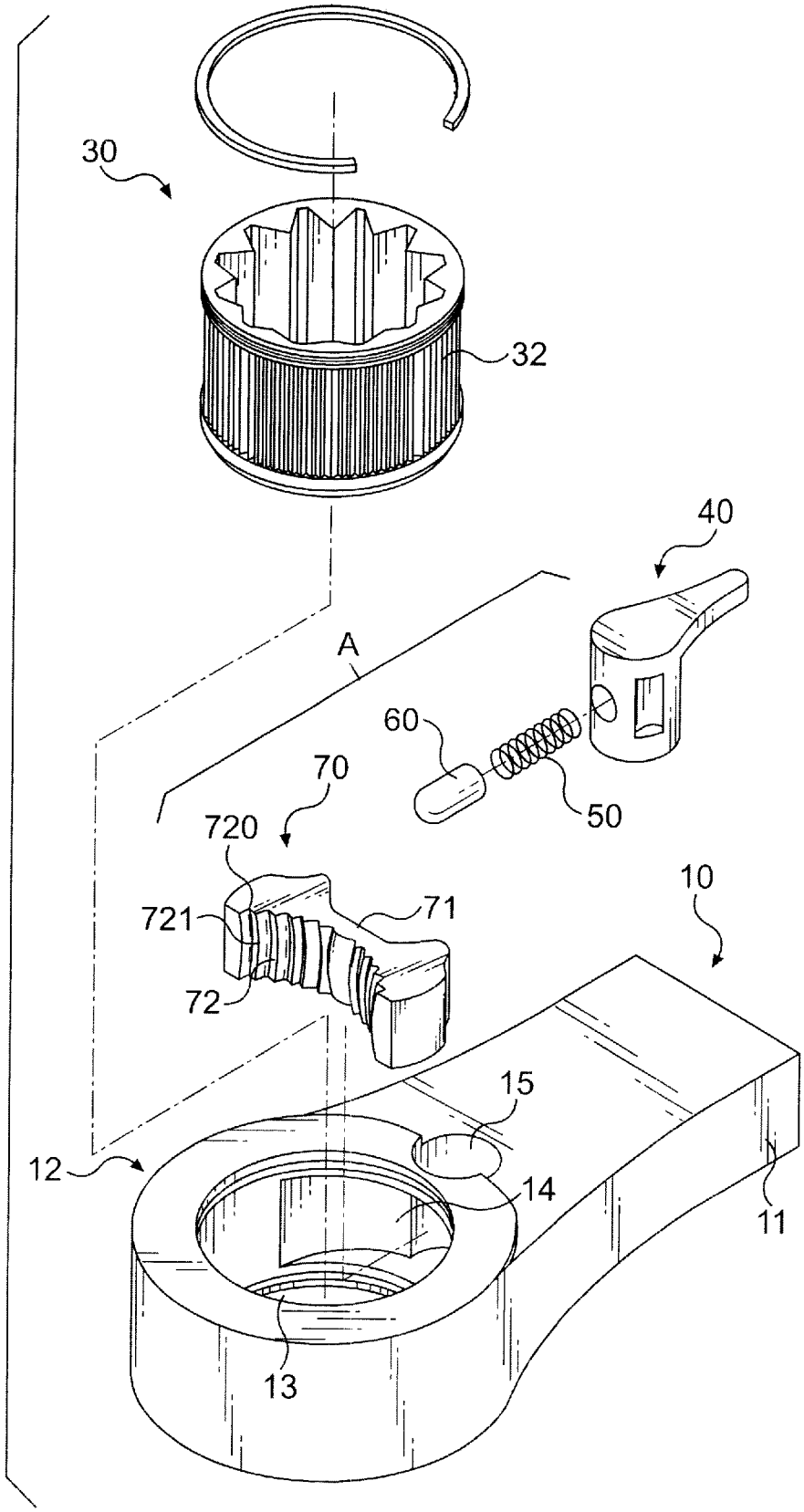
FIG. 9 is an exploded perspective view of a reversible ratchet wrench in accordance with another embodiment of the present invention.
Figure 10:
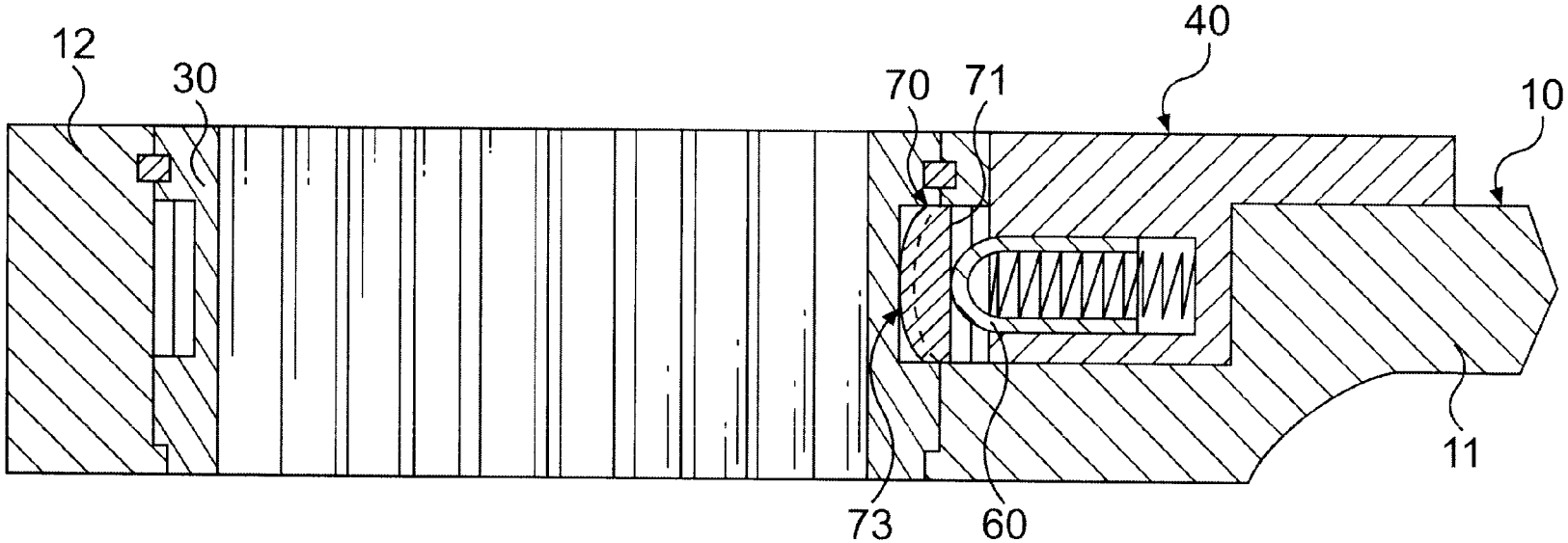
FIG. 10 is a front plan cross-sectional assembly view of the reversible ratchet wrench as shown in FIG. 9.
Figure 11:
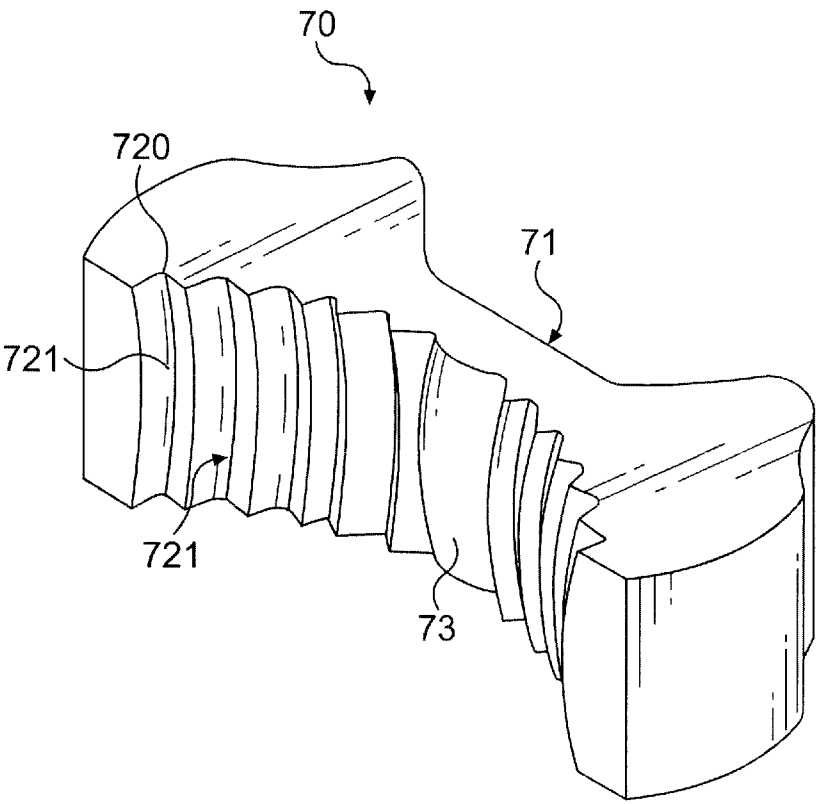
FIG. 11 is an exploded perspective view of a retaining member of the reversible ratchet wrench as shown in FIG. 9.
Figure 12:
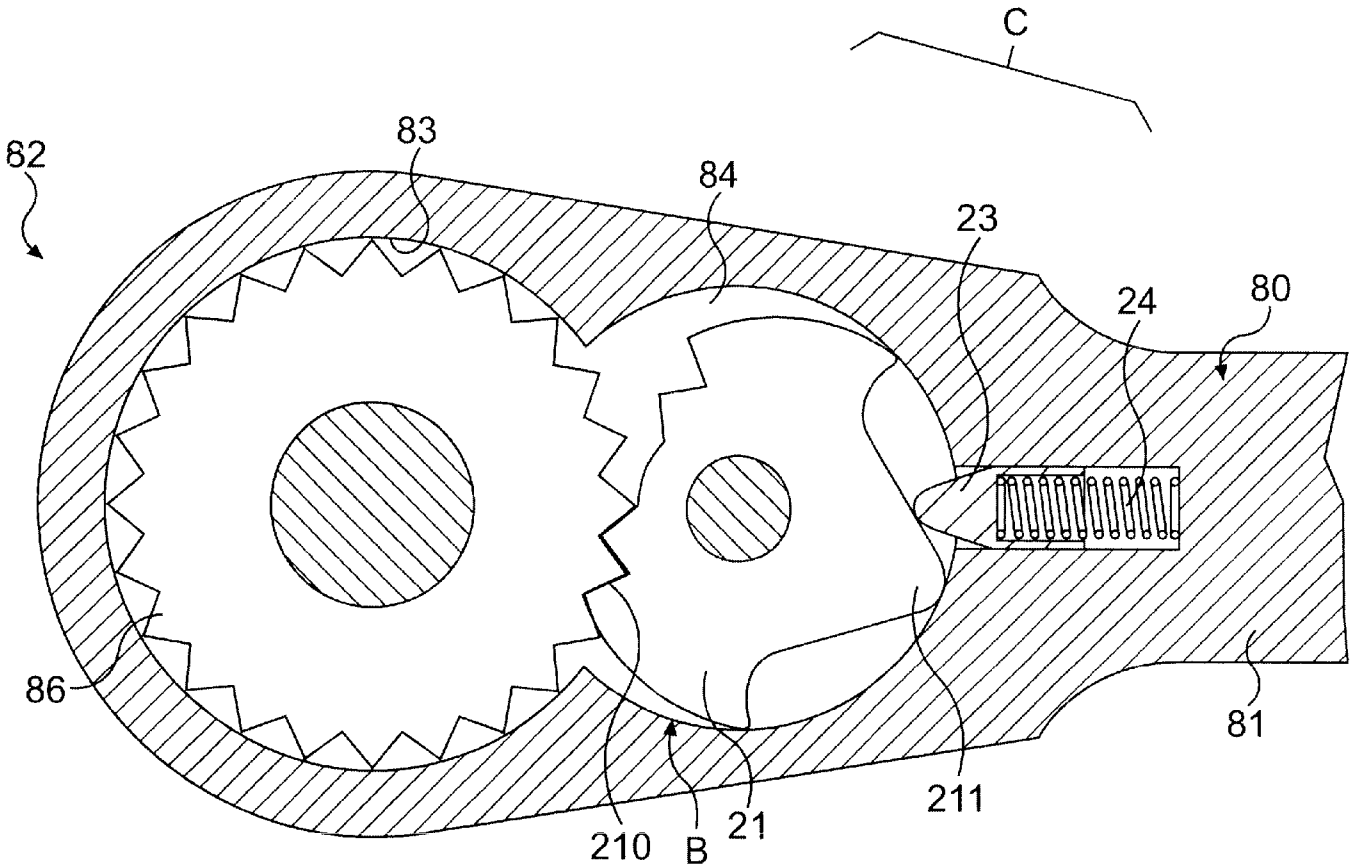
FIG. 12 PRIOR ART
FIG. 12 is a top plan cross-sectional view of a conventional reversible ratchet wrench in accordance with the prior art.

Referring to FIGS. 9–11, in accordance with another embodiment of the present invention, each of the second retaining portions 72 of the retaining member 70 has two sides each formed with a convex arcuate edge 721, and a mediate section located between the two sides and formed with a locking edge 720. In addition, each of the second retaining portions 72 of the retaining member 70 has a convex arcuate shape.

Preferably, the second retaining portions 72 of the retaining member 70 are arranged in a stepwise manner, and are arranged to form a concave arcuate shape. Preferably, the locking edge 720 of each of the second retaining portions 72 of the retaining member 70 has a flat plane shape.

Accordingly, by such an arrangement, the present invention has the following advantages.

1. Each of the second retaining portions 72 of the retaining member 70 has two sides each formed with a convex arcuate edge 721, and a flat-shaped locking edge 720 located between the two convex arcuate edges 721. In such a manner, during pivotal movement of the retaining member 70, each of the first retaining portions 32 of the driving member 30 may be quickly and smoothly received into and engaged with the respective second retaining portion 72 of the retaining member 70, and located between the two convex arcuate edges 721 of the respective second retaining portion 72 of the retaining member 70, thereby facilitating the first retaining portions 32 of the driving member 30 engaging with the second retaining portions 72 of the retaining member 70, and thereby efficiently preventing occurrence of an interference fit between the first retaining portions 32 of the driving member 30 and the second retaining portions 72 of the retaining member 70.

2. Each of the first retaining portions 32 of the driving member 30 is retained by the two convex arcuate edges 721 and the flat-shaped locking edge 720, so that each of the first retaining portions 32 of the driving member 30 may be rigidly and stably engaged with the respective second retaining portion 72 of the retaining member 70, thereby enhancing the operation efficiency of the driving member 30 for driving the workpiece.

Although the invention has been explained in relation to its preferred embodiment as mentioned above, it is to be understood that many other possible modifications and variations can be made without departing from the scope of the present invention. It is, therefore, contemplated that the appended claims will cover such modifications and variations that fall within the true scope of the invention.

What is claimed is:

1. A reversible ratchet wrench comprising:

a handle (11) having an enlarged driving head (12) defining a driving chamber (13) therein, a receiving chamber (15) defined in said handle (11) and located adjacent to said driving chamber (13), a retaining recess (14) defined in a side wall of said driving chamber (13) and connecting to said receiving chamber (15);

a driving member (30) secured in said driving chamber (13) and having an outer wall provided with a plurality of tooth-shaped first retaining portions (32); and a direction control device (A) mounted on said handle (11) and including:

(a) a direction control member (40) rotatably mounted in said receiving chamber (15);

(b) a retaining member (70) extended in a longitudinal direction pivotally mounted in said retaining recess (14), said retaining member (70) having a first side provided with first and second tooth-shaped second retaining portions (72) formed adjacent opposing longitudinal ends of said first side, said first and second tooth-shaped second retaining portions (72) having an arcuate contour in a direction transverse to said longitudinal direction, said retaining member (70) having a second side with an arcuate pressing recess (71) formed therein, said retaining member (70) being pivotable to selectively meshingly engage one of said first and second tooth-shaped second retaining portions (72) adjacent a respective end of said retaining member (70) with said plurality of tooth-shaped first retaining portions (32);

(c) a pressing member (60) mounted between said receiving chamber (15) and said retaining recess (14), said pressing member (60) being secured on said direction control member (40) to rotate therewith and slidably contact said arcuate pressing recess (71) on said second side of said retaining member (70) for pivoting said retaining member (70); and (d) an elastic member (50) mounted between said direction control member (40) and said pressing member (60) for urging said pressing member (60) against said second side of said retaining member (70);

said first side including a support portion (73) formed in a mediate portion thereof between said first and second tooth-shaped second retaining portions (72), said support portion (73) having an arcuate contour in both said longitudinal and transverse directions, said retaining member (70) being pivoted about said support portion (73).

2. The reversible ratchet wrench in accordance with claim 1, wherein each of said first and second tooth-shaped second retaining portions (72) of said retaining member (70) has two sides each formed with an edge (721) having an convex arcuate contour in said longitudinal direction, and a mediate section located between said two sides and formed with a locking edge (720) having a flat planar contour.

* * * * *